US009096404B2

(12) United States Patent
Duchstein

(10) Patent No.: US 9,096,404 B2
(45) Date of Patent: Aug. 4, 2015

(54) DEVICE AND METHOD FOR FILLING A FLEXIBLE TRANSPORT CONTAINER WITH NOTES OF VALUE

(71) Applicant: Wincor Nixdorf International GmbH, Paderborn (DE)

(72) Inventor: Mirko Duchstein, Berlin (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 14/505,654

(22) Filed: Oct. 3, 2014

(65) Prior Publication Data

US 2015/0097332 A1 Apr. 9, 2015

(30) Foreign Application Priority Data

Oct. 9, 2013 (EP) ..... 13187856

(51) Int. Cl.

| | |
|---|---|
| ***B65H 29/40*** | (2006.01) |
| ***B65H 29/22*** | (2006.01) |
| ***B65H 31/04*** | (2006.01) |
| ***B65H 31/24*** | (2006.01) |

(52) U.S. Cl.

CPC ..... *B65H 29/40* (2013.01); *B65H 29/22* (2013.01); *B65H 31/04* (2013.01); *B65H 31/24* (2013.01); *B65H 2404/1114* (2013.01); *B65H 2404/661* (2013.01)

(58) Field of Classification Search

CPC ..... B65H 29/22; B65H 29/40; B65H 2404/1114; B65H 2404/661; B65H 31/04

USPC ..... 271/315

See application file for complete search history.

(56) References Cited

U.S. PATENT DOCUMENTS

| | | | | |
|---|---|---|---|---|
| 1,269,673 | A * | 6/1918 | Armstrong | 271/178 |
| 1,778,781 | A * | 10/1930 | Wood | 271/187 |
| 4,052,053 | A * | 10/1977 | Hasegawa et al. | 271/187 |
| 4,150,757 | A * | 4/1979 | Laybourn et al. | 271/187 |
| 4,275,874 | A * | 6/1981 | DiBlasio | 271/4.1 |
| 4,312,699 | A * | 1/1982 | Erdmann et al. | 156/477.1 |
| 4,342,325 | A * | 8/1982 | Lundblad | 221/7 |
| 5,421,700 | A * | 6/1995 | Kranz | 414/798.5 |
| 8,276,902 | B2 * | 10/2012 | Holland-Letz et al. | 271/3.14 |
| 2002/0096821 | A1 * | 7/2002 | Sato et al. | 271/177 |
| 2011/0042889 | A1 * | 2/2011 | Holland-Letz et al. | 271/264 |
| 2011/0186488 | A1 * | 8/2011 | Nordin | 209/534 |
| 2012/0067011 | A1 | 3/2012 | Holland-Letz et al. | |
| 2012/0167529 | A1 * | 7/2012 | Langhuber et al. | 53/467 |
| 2012/0195732 | A1 * | 8/2012 | Moulin et al. | 414/788.1 |
| 2014/0196416 | A1 | 7/2014 | Duschstein | |

(Continued)

FOREIGN PATENT DOCUMENTS

| | | | |
|---|---|---|---|
| DE | 102009015047 | A1 | 9/2010 |
| DE | 102009053155 | A1 | 5/2011 |

(Continued)

OTHER PUBLICATIONS

IBM Technical Disclosure Bulletin, "Bill Stacker for Bill-Handling Machine" vol. 30 No. 12, May, 1988 (1 page).

*Primary Examiner* — Patrick Cicchino

(74) *Attorney, Agent, or Firm* — Harness, Dickey & Pierce, P.L.C.

(57) ABSTRACT

A device for filling a transport container with sheet-shaped notes of value includes a feeding unit and a removal unit. Notes of value are fed via a vane wheel for forming a stack. The removal unit has an elastic guiding element which limits the movement of the note of value fed by the vane of the vane wheel and falling down vertically.

10 Claims, 4 Drawing Sheets

(56) References Cited

U.S. PATENT DOCUMENTS

| | | | | |
|---|---|---|---|---|
| 2014/0327206 | A1* | 11/2014 | Kong et al. | 271/178 |
| 2014/0331612 | A1* | 11/2014 | Jeschke et al. | 53/447 |

FOREIGN PATENT DOCUMENTS

| | | | | |
|---|---|---|---|---|
| DE | 102011000790 | A1 | 8/2012 | |
| EP | 0852279 | A2 | 7/1998 | |
| GB | 2236143 | A | 3/1991 | |
| GB | 2489694 | A | 10/2012 | |
| WO | WO 9523757 | A1 * | 9/1995 | B65H 29/70 |
| WO | WO-0219289 | A2 | 3/2002 | |
| WO | WO-2009138497 | A1 | 11/2009 | |
| WO | WO-2013/079717 | A2 | 6/2013 | |

* cited by examiner

DEVICE AND METHOD FOR FILLING A FLEXIBLE TRANSPORT CONTAINER WITH NOTES OF VALUE

CROSS-REFERENCE TO RELATED APPLICATIONS

This application claims priority to European patent application EP 13 187 856.3 filed Oct. 9, 2014 which is hereby incorporated by reference in its entirety.

BACKGROUND OF THE INVENTION

The invention relates to a device for filling a flexible transport container with sheet-shaped notes of value, comprising a feeding unit which feeds the sheet-shaped notes of value individually and one after the other to a vane wheel having elastic vanes, whereupon each vane carries on one single note of value in a rotary motion and the note of value falls into a collecting area due to its gravity and rests on edge on a bottom plate thereat. Such a device is known from WO 2013/079717 of the same applicant.

For accommodating notes of value, for example banknotes, in automated teller machines, automatic cash register systems or automatic cash safes thin-walled flexible transport containers, so-called safe bags, are used in which the notes of value are received similar to a plastic bag. Before the notes of value are transported into the transport container, these have to be stacked so that the filling of the transport container takes place in stacks. The formation of the value note stacks is critical since, on the one hand, the stacking operation has to take place relatively quickly and, on the other hand, the feeding of notes of value to the stack has to take place in a tidily arranged manner to prevent a disorder of the notes of value.

According the above-mentioned WO 2013/079717, a vane wheel having elastic vanes is used for the formation of the stack, the fed note of value resting against a stacking wall. When a value note stack has been formed, then the stack is transported to the opening of the transport container by means of a removal unit and stored therein. A closing unit in the form of a shutter device is arranged between the transport container and the removal unit and forms the stacking wall in the closed state and lets the stacked notes of value pass through to the transport container in the open state.

In practice, it has shown that when the notes of value are fed quickly it may happen that a note of value jams or does not rest against the previous note of value in a correct position during formation of the stack. Moreover, loosely stacked notes of value may jam or experience changes in their position during the transport movement to the transport container.

SUMMARY OF THE INVENTION

Therefore, it is the object of the invention to specify a device and a method for filling a thin-walled transport container with notes of value, by means of which a quick stacking of notes of value is reliably possible.

In the device according to an embodiment of the invention, the removal unit has an elastic guiding element connected thereto, which guides the note of value fed by the vane of the vane wheel and falling down vertically to the bottom plate. In this way, on the one hand, a guidance of the note of value fed to the stack is performed by the elastic vane of the vane wheel in the upper portion of the note of value and, in addition, guidance is performed by the elastic guiding element in the lower portion of the note of value. In this way, as a result of the improved guidance, a displacement or a tilting of the fed note of value will not occur. Thus, the stacking of notes of value is performed reliably and duly even when the notes of value are fed quickly. The elasticity of vane and vane wheel is chosen such that the friction forces acting on the note of value are considerably lower than the weight of the note of value. Thus, it is prevented that the on-edge position of the note of value on the bottom plate is not changed when the vane wheel is rotated further, and is even not changed when the vane, when rotated further, presses the note of value against the already present stack. In a similar way, the elastic guiding element at the removal unit does not change the position of the note of value either but only provides a guidance when the note of value falls down due to its gravity.

In this way, a tidy stack of notes of value is formed in the collecting area, which stack can be moved into the transport container by the removal unit.

When the removal unit transports the stack of notes of value in the open state of the closing unit towards the opening of the transport container, then the guiding element mounted on the removal unit presses softly against the last note of value of the stack due to its elasticity so that this stack changes from a loose state into a somehow denser state in which it can be moved more easily and remains its geometric shape. In this way, the reliability during the transport of the stack is further improved.

According to one embodiment, the vane wheel comprises spaced apart partial vane wheels, as viewed in axial direction, the vanes of which are aligned with one another, as viewed in axial direction. The division into partial vane wheels allows a further reduction of the friction force exerted on the note of value without the guiding function being negatively affected hereby.

It is advantageous when the elastic guiding element comprises guiding fingers, as viewed in axial direction, which are spaced apart and are arranged opposite to the spaces between the partial vane wheels. By the division into guiding fingers, the friction force acting on the note of value is further reduced without the guiding function being negatively affected. Due to the arrangement in the area between the partial vane wheels the guidance of the notes of value along the vanes and along the guiding fingers is improved in a combinatorial guiding effect.

It is advantageous when the guiding element or the guiding fingers, as viewed from the value note stack, are convexly shaped. As a result thereof, the friction forces acting on the notes of value are reduced further without restricting the guiding function.

According to a further aspect of the invention, a method for filling a transport container with notes of value is specified. In this method, the notes of value are guided by a feeding unit via a vane wheel to a collecting area and vertically fall down thereat due to their gravity and rest on edge on a bottom plate. While falling down, the notes of value are guided along an elastic guiding element which is mounted on the removal unit. This removal unit transports a stack formed of notes of value in an open state of the closing unit to the opening of the thin-walled flexible transport container, wherein the elastic guiding element presses against the uppermost note of value of the stack.

According to this method, a reliable and safe stacking of notes of value takes place also when the notes of value are fed quickly. Moreover, a compact shape of the value note stack is achieved, which is advantageous when the stack is transported into the transport container by the removal unit.

BRIEF DESCRIPTION OF THE DRAWINGS

Further features and advantages of the invention result from the following description which explains the invention in more detail on the basis of embodiments in connection with the enclosed Figures.

DETAILED DESCRIPTION OF THE PREFERRED EMBODIMENTS

Figure 1:
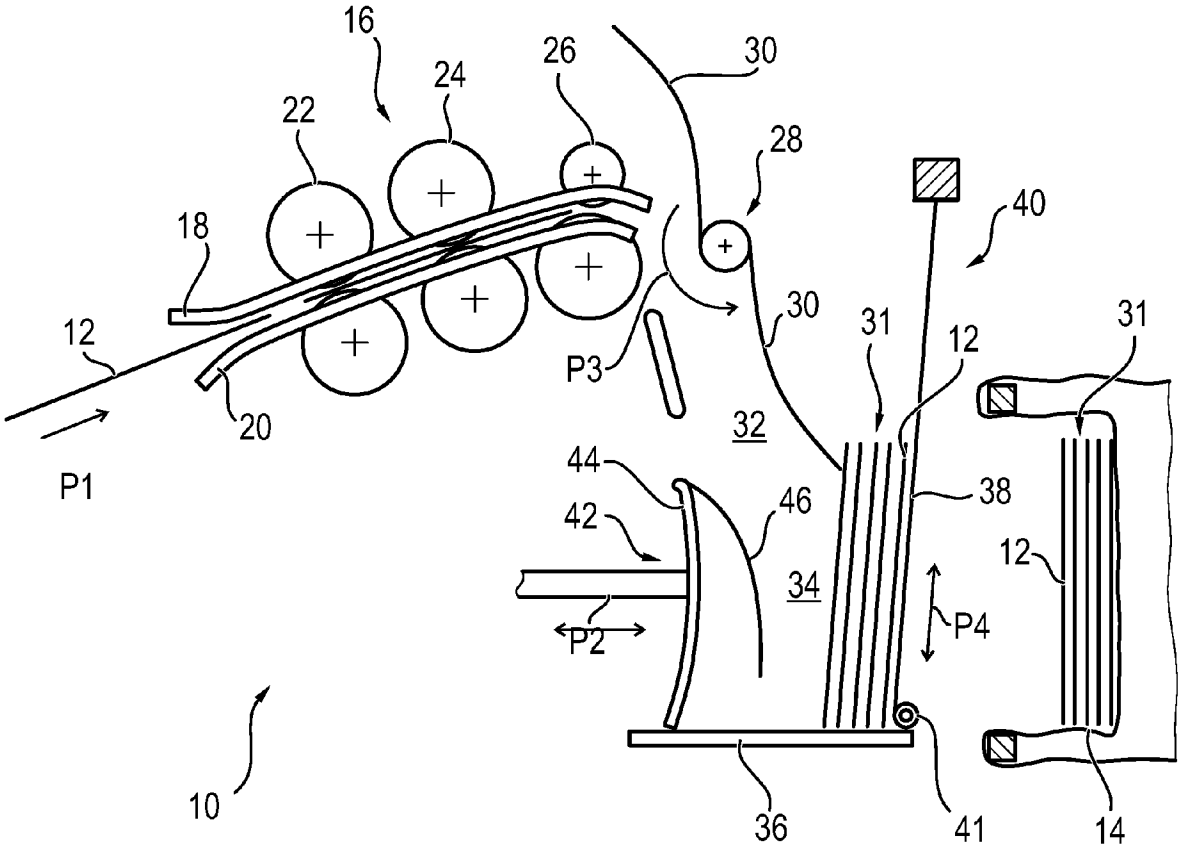
FIG. 1 shows a schematic illustration of a device for feeding notes of value to a transport container.

FIG. 1 shows a schematic side view of a device 10 for feeding notes of value 12 to a thin-walled flexible transport container 14. This only roughly outlined transport container 14 is, for example, a thin plastic bag in which the notes of value 12 are received for the further transport later on. Such a plastic bag for receiving notes of value 12 is often also referred to as a safe bag.

The notes of value 12 are transported in the direction P1 via a feeding unit 16 along transport rails 18, 20 by means of transport roller pairs 22, 24, 26. When rotated, a vane wheel 28 having several vanes 30 (in the present example two vanes 30) transports the notes of value 12 arriving at the end of the transport rails 18, 20 further in the direction P3. When a note of value 12 transported in this way has been transported into the free space area 32, it falls down vertically due to its gravity in order to be collected in a collecting area 34. In this collecting area 34, the note of value 12 rests on edge on a bottom plate 36. The first note of value 12 rests against a stacking wall 38 which is formed by a shutter of the closing unit 40. The stacking wall 38 has a small angle relative to the vertical so that the note of value 12 slightly leans against it. When the vane wheel 28 is rotated further, the vane 30 transports the fed note of value to the forming stack 31 and presses the respective note of value 12 slightly against the stack 31.

A removal unit 42 movable in the direction of the double-headed arrow P2 has a front plate 44 which, in its upper area, has an elastic and flexible guiding element 46. This guiding element 46 is convexly shaped, when viewed from the stack 31. When the note of value 12 falls down towards the bottom plate 36 due to its gravity, then it is guided by the guiding element 46 so that the note of value 12 leans against the stacking wall 38 or against the last stacked note of value in correct position. Thus, when falling down, the note of value 12 is guided, on the one hand, by the vane 30 and, on the other hand, by the guiding element 46.

When the stack 31 of notes of value 12 has a sufficient volume, e.g. 30 notes of value, the stacking wall 38 goes upwards according to the principle of a shutter, wherein a shutter roll 41 moves upwards and rolls up a flexible web, for example a tissue web, with a smooth rolling up along the first note of value of the stack 31. In this way, an opening towards the transport container 14 is provided and the removal unit 42 moves to the right in FIG. 1 in order to transport the formed stack of notes of value 12 into this transport container 14. During this transport movement, the elastic guiding element 46 mounted on the front plate 44 fulfills a further function. The notes of value 12 in the stack 31 are loosely stacked; when the removal unit 42 is moved to the right, at first the elastic guiding element 46 presses against this stack 31 and compresses the same. In this way, the stack 31 becomes more stable with respect to its form and in the further movement of the removal unit 42 it is reliably fed to the transport container 14 by the front plate 44 without notes of value 12 being displaced. After the stack 31 has been stowed away in the transport container 14, the removal unit 42 is moved to the left in FIG. 1 in accordance with the double-headed arrow P2 and a further stack of notes of value 12 is formed.

In the following Figures, the same elements are identified with the same reference signs.

Figure 2:
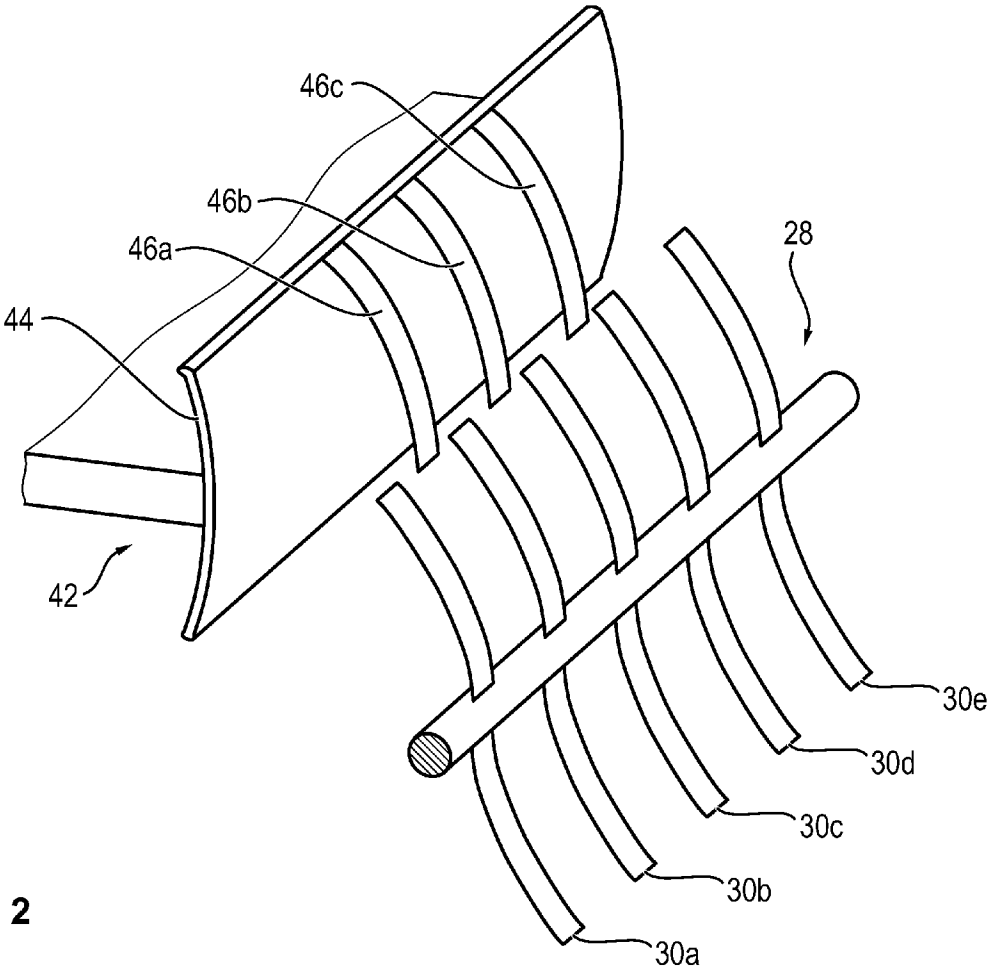
FIG. 2 shows a perspective view of the vane wheel and the removal unit.

In a perspective illustration, FIG. 2 shows the vane wheel 28 with five spaced apart partial vane wheels, the vanes of which 30*a* to 30*e* are aligned with one another, as viewed in axial direction. They interact with guiding fingers 46*a*, 46*b*, 46*c* which form the elastic guiding element 46. As viewed from above in a top view, these guiding fingers 46*a* to 46*c* are arranged such that they are opposite to the spaces between the vanes 30*a* to 30*e*. In this way, a reduced friction force is exerted on the respective note of value 12 by the guiding fingers 46*a* to 46*c* and the vanes 30*a* to 30*e*. The guiding fingers 46*a* to 46*c* and the vanes 30*a* to 30*e* are made of elastic plastic, e.g. of an elastomer.

Figure 3:
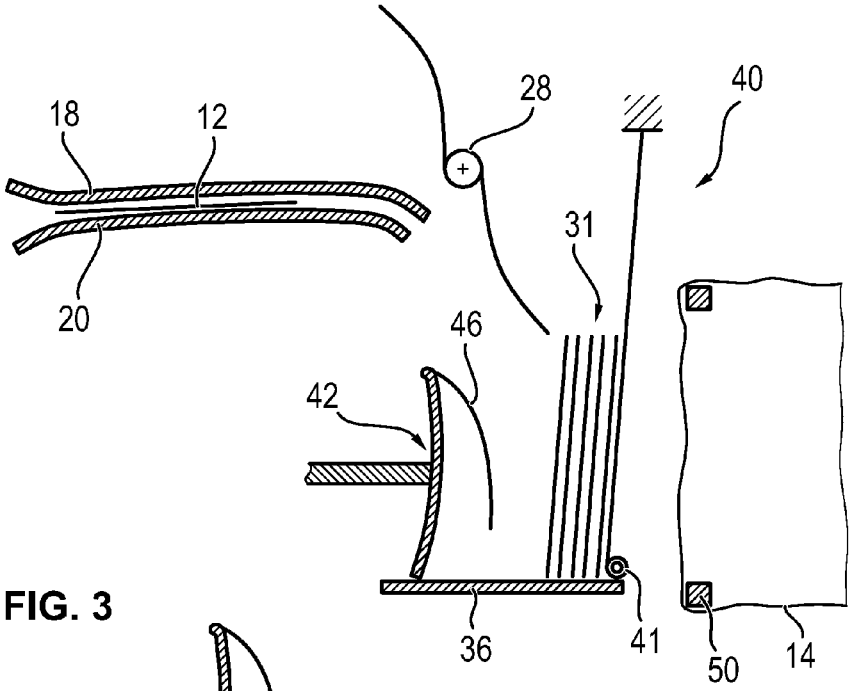
FIG. 3 shows a schematic illustration of the device according to FIG. 1 in a first operating state.
Figure 4:
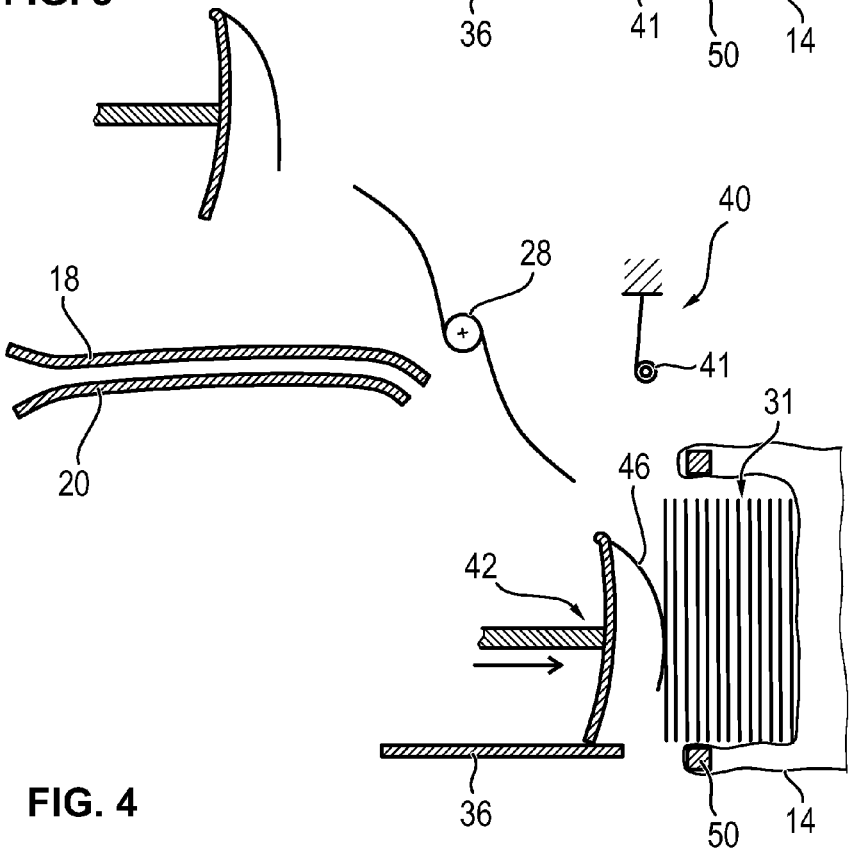
FIG. 4 shows a schematic illustration of the device in a second operating state, in which a stack of notes of value is transported into the transport container.
Figure 5:
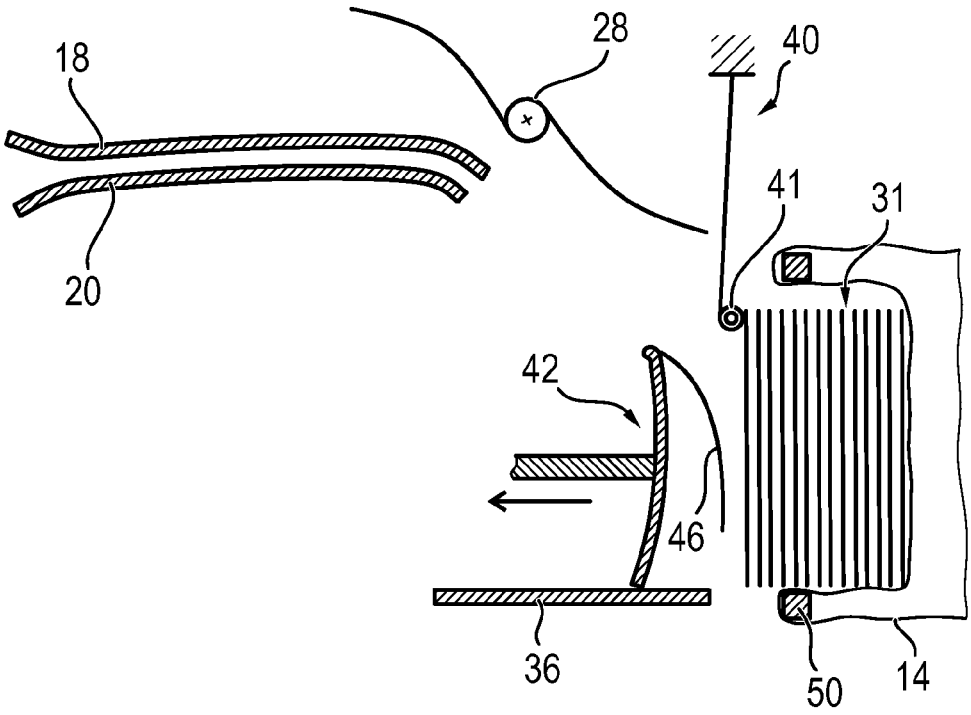
FIG. 5 shows a schematic illustration of the device in a third operating state in which the removal unit is pulled back in order to reach the first operating state.

FIGS. 3 to 5 schematically show the stacking of the notes of value 12 and their transport into the transport container 14. For filling with notes of value 12, the transport container 14, e.g. a type of plastic bag, is turned inside out so that as long as no notes of value 12 are received therein its inside is turned outside and its outside is turned inside. The transport container 14 is put over a closing frame 50 by which an opening is formed through which the notes of value 12 are fed to the transport container 14. After the transport container 14 has been completely filled with notes of value 12, opposite elements of the closing frame 50 are moved towards each other, as a result whereof the opening of the transport container 14 is irreversibly closed. In particular, snap-in elements are provided which, for closing the transport container 14, snap into each other such that they cannot be disconnected again in a non-destructive manner.

As explained in connection with FIG. 1, notes of value 12 are fed to the vane wheel 28 along transport rails 18, 20, the vanes of the vane wheel forwarding the notes of value 12 so that they rest on edge on the bottom plate 36. The first note of value 12 of the forming stack 31 rests against the shutter of the closing unit 40 which is in a closed position. With its guiding element 46, the removal unit 42 supports the formation of the stack 31. During stack formation, the vanes press the last-fed note of value against the already present notes of value 12 so that the stack 31 is compressed in the upper region. In the lower region of the note of value 12, the spring force of the guiding element 46 causes an orderly feeding of the note of value 12 to the forming stack 31 (in practice, the guiding element is arranged further to the right in the Figure towards the stack 31, which, for reasons of better clarity, is not shown in the schematic illustration). In the closed position shown in FIG. 3, the closing unit 40 is arranged such that it closes the stack 31 in the direction of the transport container 14. The associated shutter forms the stacking wall against which the first note of value 12 of the stack 31 leans. As mentioned, the closing unit 40 is designed as a shutter device, wherein the shutter being almost completely unrolled in the closed position.

FIG. 4 shows a second operating state in which the shutter of the closing unit 40 is rolled up to the top and thus provides access to an opening in the closing frame 50. The removal unit 42 is moved to the right in FIG. 4 and, in doing so, supported by the resilient guiding element 46, pushes the stack 31 through the formed opening into the transport unit 14, the stack 31 pressing against the inside of the transport container 14 that has been turned inside out and thus turns said transport container step-by-step outside in, the inside of which facing inwards and contacting the notes of value 12.

FIG. 5 shows a third operating state in which the removal unit 42 is moved back in the direction of the arrow indicated. Upon reversal of the direction of movement of the removal unit 42, the spring element 48 cushions the reversal pressure arising by driving the removal unit so that the stack remains in the transport container reliably and in correct position. In this state, the shutter of the closing unit 40 is partially unwound so that it is in a retaining position. In this position, the opening for the transport containers 14 is partially closed and in fact so far that the removal unit 42 can move back into its initial position. The notes of value 12 stored in the transport container 14 are retained in this retaining position, as a result whereof a safe deposit of the notes of value 12 in the transport container 14 is possible. The removal unit 42 continues to move backwards until it reaches the position according to FIG. 3 in which notes of value 12 are again fed via the transport rails 18, 20 and stacked. For this, the shutter of the closing unit 40 is again fully lowered to form a stacking wall for the stack 31 to be formed.

The separation of the notes of value 12, the feeding via the feeding unit 16, as well as the drive of the vane wheel 28, the removal unit 42, the closing unit 40 and of the closing frame 50 take place by means of a control (not illustrated) which also synchronizes the various mechanical movements. One example of such a control as well as further details for the closing unit 40 are described in the already mentioned WO 2013/079717 A2, the content of which is incorporated into the present patent application by reference.

What is claimed is:

1. A device for filling a transport container with sheet-shaped notes of value, comprising:

a feeding unit which feeds the sheet-shaped notes of value individually and one after another to a vane wheel having elastic vanes, wherein each vane carries one note of value in a rotary motion and the note of value falls into a collecting area due to gravity and rests on edge on a bottom plate in the collecting area, wherein when the vane wheel is rotated further, the vane guides the note of value resting on edge in the direction of a stacking wall, a closing unit which forms the stacking wall in a closed position and lets stacked notes of value pass in horizontal direction towards an opening of the thin-walled, flexible transport container in an open position, a removal unit which transports the stack of notes of value in the open state of the closing unit to the opening of the transport container, wherein the removal unit has an elastic guiding element mounted thereto, which limits the movement of the note of value fed by the vane of the vane wheel and falling down vertically.

2. The device according to claim 1, wherein the vane wheel comprises spaced apart partial vane wheels, as viewed in axial direction, the vanes of which are aligned with one another, as viewed in axial direction.

3. The device according to claim 2, wherein the elastic guiding element comprises guiding fingers, as viewed in axial direction, which, as viewed from above in a top view, are arranged opposite to the spaces between the partial vane wheels.

4. The device according to claim 1, wherein the guiding element or the guiding fingers are convexly shaped.

5. The device according to claim 1 wherein, between the ends of the vanes and the boundary of the guiding element or the guiding fingers a free space exists which allows that the fed note of value falls down onto the bottom plate under its own gravity.

6. The device according to claim 1, wherein the vane wheel is arranged such that the ends of the respective vane press the respective note of value in its upper region against the stacking wall or against the note of value fed to the stack when the vane wheel is rotated further.

7. The device according to claim 1, characterized in that the elastic guiding element is made of resilient plastic.

8. The device according to according to claim 1, wherein the vanes of the vane wheel are made of elastic plastic.

9. A method for filling a transport container with sheet-shaped notes of value, in which a feeding unit feeds the sheet-shaped notes of value individually and one after another to a vane wheel having elastic vanes, wherein each vane carries one note of value in a rotary motion and the note of value falls into a collecting area due to gravity and rests on edge on a bottom plate in the collecting area, comprising:

when the vane wheel is rotated further, the vane guides the note of value resting on edge in the direction of a stacking wall, a closing unit which forms the stacking wall in a closed position and lets stacked notes of value pass in horizontal direction towards an opening of the thin-walled flexible transport container in an open position, a removal unit transports the stack of notes of value in the open state of the closing unit to the opening of the transport container, and the removal unit has an elastic guiding element mounted thereto, which limits the movement of the note of value fed by the vane of the vane wheel and falling down vertically.

10. The method according to claim 9, wherein the vane wheel is arranged such that the ends of the respective vane press the respective note of value in its upper region against the stacking wall or against the note of value fed to the stack when the vane wheel is rotated further.

* * * * *